United States Patent [19]

Moyer

[11] 4,075,826

[45] Feb. 28, 1978

[54] TIMING CIRCUIT FOR DIGITAL WRISTWATCH

[75] Inventor: Norman E. Moyer, Newport Beach, Calif.

[73] Assignee: Hughes Aircraft Company, Culver City, Calif.

[21] Appl. No.: 578,689

[22] Filed: May 19, 1975

[51] Int. Cl.[2] ..... G04C 3/00; G04B 19/00

[52] U.S. Cl. ..... 58/23 R; 58/50 R

[58] Field of Search ..... 58/23 R, 50 R, 153; 340/324 M, 336

[56] References Cited

U.S. PATENT DOCUMENTS

| | | | |
|---|---|---|---|
| 3,828,548 | 8/1974 | Martin | 58/50 R |
| 3,839,856 | 10/1974 | Dargent | 58/4 A |
| 3,854,277 | 12/1974 | Samejima | 58/50 R |
| 3,943,696 | 3/1976 | Portmann et al. | 58/23 R |

OTHER PUBLICATIONS

Robert Lyon Caen, Diodes, Transistors and Integrated Circuits for Switching Systems, 1968, pp. 351–355.

*Primary Examiner*—Edith S. Jackmon
*Attorney, Agent, or Firm*—W. H. MacAllister; F. I. Konzem

[57] ABSTRACT

A timing circuit in a digital watch with a two digit display. When the circuit is activated by a push button, the two display elements first display the hours information, for as long as the push button is depressed, and after release of the push button, the display elements show minutes for about one-half second before turning off.

3 Claims, 3 Drawing Figures

TIMING CIRCUIT FOR DIGITAL WRISTWATCH

BACKGROUND OF THE INVENTION

1. Field of the Invention

This invention relates to a digital timing circuit, and more particularly to a timing circuit in a digital wristwatch for displaying both hours and minutes information sequentially by using a two digit display.

2. Description of the Prior Art

In the art, digital watches have used four display elements to display the horological information. Usually, two of the display elements display the hours and the other two display elements display the minutes; either liquid crystal or light emitting diode (LED) display elements have been used.

In order to construct a ladies' digital watch, the size of the watch and its electronics must be reduced considerably, as compared to the men's digital watch for aesthetic reasons. One of the major limiting factors in the size of the digital watch is that four display elements have been necessary to display the horological information. In the present invention, though, the width of the digital watch can be reduced to almost half that of the prior art digital watches because only two display elements instead of the four display elements are used.

The digital timing circuit of the present invention allows a digital watch to be constructed, using only two display elements instead of the prior art four display elements, by displaying the time in a sequential manner, first the hours and then the minutes when said circuit is activated by a push button. Also, the digital timing circuit allows the hours information to be displayed as long as the push button is depressed and then the minutes information after releasing the push button.

SUMMARY OF THE INVENTION

The digital timing circuit, in accordance with the invention, consists of a two bit counter, a latch circuit, and a push button for activating the timing sequence. With the push button and thereby the timing circuit unactivated, the two display elements in the digital watch are blank. But upon activating the push button by depressing it, the hours are displayed, and then upon releasing the push button the minutes information is shown for about half a second before the display finally turns off.

Accordingly, it is an object of this invention to provide a timing circuit, in a digital watch which allows both hours and minutes to be displayed in a sequential manner on a two digit display.

Another object is to provide a digital timing circuit which allows the hours information to be displayed as long as the push button is depressed, followed by the minutes information.

Another object is to provide a timing circuit which allows the width of a digital watch to be reduced by approximately one-half.

It is a further object to provide a digital timing circuit which will provide a lower power consumption rate for the batteries of said digital watch. This lower power results because fewer digits are on for a shorter time, compared to prior art LED watches.

The features of the present invention which are believed to be novel are set forth with particularity in the appended claims. The present invention, both as to its organization and manner of operation, together with further objects and advantages thereof, may be better understood by reference to the following description, taken in connection with the accompanying drawings.

DETAILED DESCRIPTION

Figure 1:
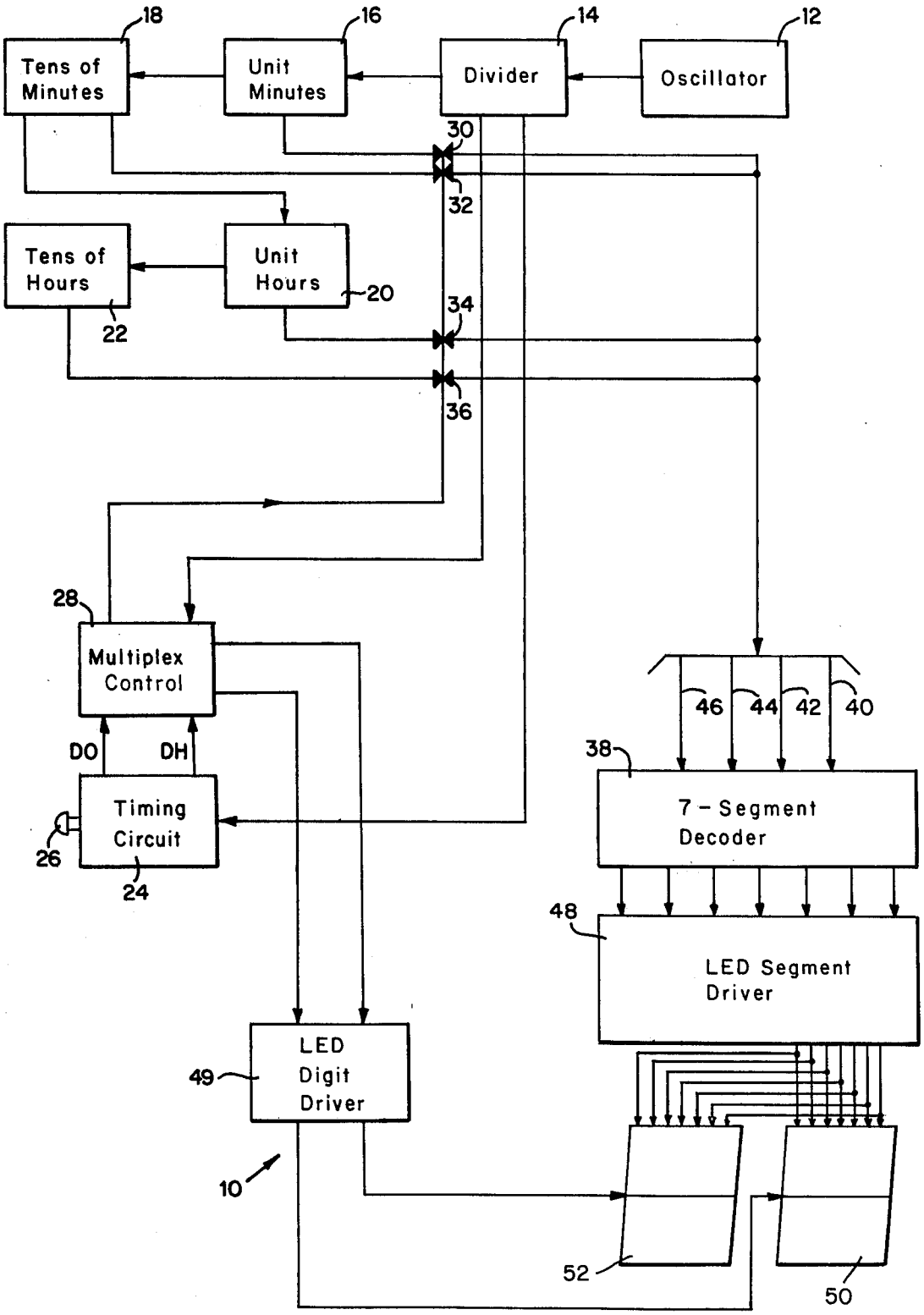
FIG. 1 is a block diagram of the circuitry of a digital watch incorporating the timing circuit of this invention.

Referring now to FIG. 1, a block diagram of the electronic digital watch 10 includes an electronic oscillator 12, which is crystal-controlled to oscillate at a predetermined and substantially constant frequency. The output from the crystal-controlled oscillator 12 is driven into a CMOS divider 14 which results in an output of one per minute. This is then driven into the unit minutes counter 16, which is a standard CMOS decade counter, which counts from 0 to 9. This unit minutes counter in turn drives the CMOS tens-of-minutes counter 18 which must count from 0 to 5 to satisfy the requirement of 60 minutes per hour. Similar to the unit minutes counter's operation, the tens-of-minutes counter 18 drives the unit hours counter 20, which is a decade counter. The unit hours counter 20 then drives the tens-of-hours counter 22, which counts from 0 to 1. Additional logic circuitry causes the hours counters to go from 12 to 1.

Seven-segment decoder 38 receives binary coded decimal (BCD) signals from the counters and outputs seven signals which correspond to the seven segments of the LED display devices so that, when turned on to be visibly distinctive, the segments represent the digit corresponding to the counter state. Since it is desired to display different horological information, it is necessary to switch different counters into the input of the seven-segment decoder. For simplicity, a single seven-segment decoder 38 is employed, and its inputs are multiplexed. There are four input lines 40, 42, 44, and 46 to the seven-segment decoder, each carrying one bit of the BCD information from the counters. Transmission gate sets 30, 32, 34, and 36 respectively connect BCD counters 16, 18, 20, and 22 to lines 40, 42, 44, and 46.

Normally, the display elements 50 and 52 are blank, until the digital timing circuit 24 of the present invention is activated by the depression of push button 26. Said timing circuit receives an input signal of 4 Hertz from the divider 14. Timing circuit 24 has two outputs, DO (Display On) and DH (Display Hours). When the binary level of DH is at a high level, the multiplex control 28 alternately opens transmission gate sets 34 and 36 and thus delivers the unit hours and tens-of-hours binary coded decimal (BCD) information to the seven-segment decoder 38. Decoder 38 in turn receives the BCD signals from said counters and outputs seven signals which correspond to the seven segments of the LED display devices. The seven signals are then delivered to the LED segment driver 48 which enables display of said signals on both LED display elements 50 or 52. Multiplex control 28 also delivers signals to the LED digit driver 49 which causes the unit hours information to be displayed on display element 50 and the tens-of-hours information to be displayed on element 52. Additional logic circuitry causes a blank rather than a zero to be displayed when the tens-of-hours are zero.

When the DO output from timing circuit 24 is at a low binary level the LED display elements are turned off by the signals to the digit driver 49.

Finally, when the DH output is at a low binary level, the multiplex control 28 alternately opens transmission gate sets 30 and 32 and allows the information from unit minutes counter 16 and tens-of-minutes counter 18 to be delivered to seven-segment decoder 38 which in turn delivers said information in the form of seven signals which correspond to the seven segments of the LED display to the LED segment driver 48. Multiplex control 28 also delivers signals to the LED digit driver 49 which causes the unit minutes information to be displayed on LED display element 50 and the tens-of-minutes information to be displayed on LED display element 52.

Thus, as long as push button 26 is depressed, the timing circuit 24 delivers the hour information to be displayed on the two LED's 50 and 52, when the push button is released the minutes information is delivered to LED segment driver 48, which in turn displays the information on the LED's for about one-half second, and finally the display turns off. The circuit could be designed to include a blank period between the hours and minutes display to further separate the information.

The electronics of such a digital watch as shown in FIG. 1 is disclosed in detail in application Serial No. 558,183, filed March 13, 1975, entitled "Digital Watch with Liquid Crystal and Light Emitting Diode Displays," by E. C. Ho said patent application is assigned to the same assignee as the present invention. The subject matter of this cross-reference is hereby incorporated herein in its entirety.

Figure 2:
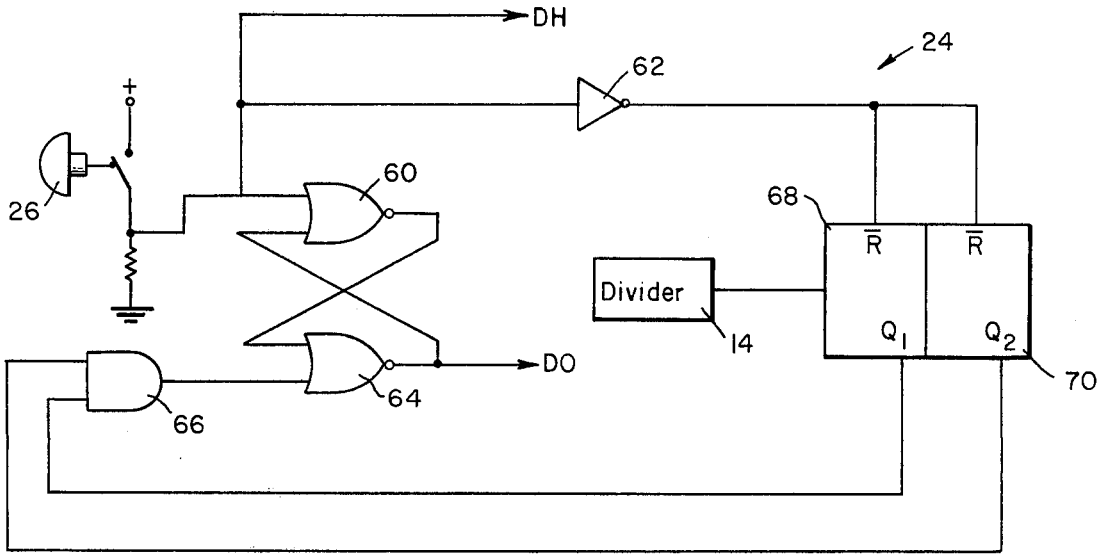
FIG. 2 is a logic diagram of the digital timing circuit of the present invention.

Referring now to FIG. 2, digital timing circuit 24 consists of push button 26 which is connected to a load resistor 25, to a first input to NOR gate 60, to the input to inverter 62 and to the output display hours (DH), which goes to multiplex control 28. The second input to NOR gate 60 is connected from the output of NOR gate 64 which is the output display on (DO). The output of NOR gate 60 is connected to a first input to NOR gate 64. The second input to NOR gate 64 is connected to the output of AND gate 66, which in complementary metal oxide semiconductor (CMOS) construction is actually part of NOR gate 64.

Toggle flip-flop 68 is clocked by a 4 Hertz input pulse from divider 14. Toggle flip-flop 70 is clocked by the output of toggle flip-flop 68. Flip-flops 68 and 70 are reset by the output of inverter 62. The outputs of these flip-flops Q1 and Q2 are inputted into AND gate 66.

THE OPERATION

Figure 3:
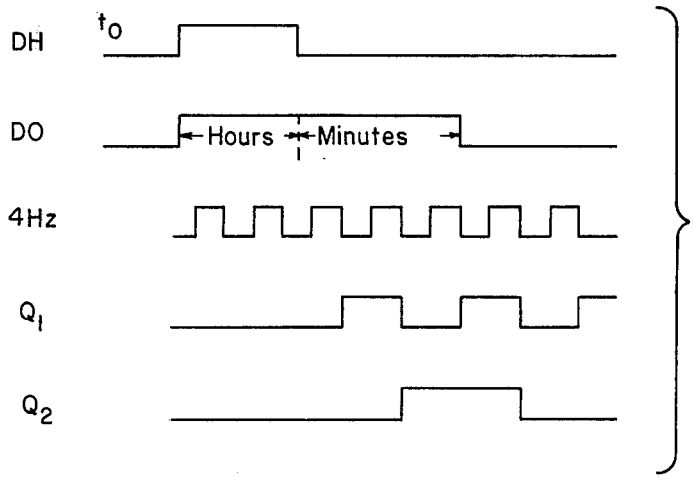
FIG. 3 is a timing diagram for the digital timing circuit of FIG. 2.

FIG. 3 is a timing diagram for the digital timing circuit of FIG. 2. It is employed to show the operation of said timing circuit. The normal condition of timing circuit 24, with push button 26 unactivated is shown in FIG. 3, at time t0; the states of flip-flops 68 and 70, and the 4 Hz clock pulse is irrelevant. However, $Q_1$ and $Q_2$ had both been at the high level sometime in the past. Thus, the output of AND gate 66 had been high in turn making the output of NOR gate 64, which is (DO) at a low binary level. Also, since the push button 26 is unactivated or at a low binary level, output (DH) which is directly connected to push button 26 is also at a low binary level. Thus the output of NOR gate 60 is high and the output of NOR gate 64 is held low. Since output (DO) is low, no horological information is displayed on LED display elements 50 or 52.

When push button 26 is activated, output (DH) goes to a high binary level as shown on the timing diagram of FIG. 3. Inverter 62 inverts this high binary level signal to a low which is delivered to the reset inputs forcing said flip-flops so that their respective outputs Q1 and Q2 are in the low state. Thus AND gate 66, has a low output. NOR gate 60 has a low output, and therefore NOR gate 64 has a high output. Therefore, as long as push button 26 is depressed or activated, a high binary level signal is delivered to both outputs (DH) and (DO), since flip-flops 68 and 70 are held reset.

As soon as push button 26 is released or unactivated again, inverter 62 delivers a high binary level signal to the reset inputs of flip-flops 68 and 70, thereby letting these counters count. The minutes information is displayed on LED display elements 50 and 52 while the counter outputs Q1 and Q2 are in the 00, 01, and 10 states. But as soon as the Q1 and Q2 outputs are both at a high binary level, the cross coupled NOR gates 60 and 64 are flipped back to the state where (DO) is a low binary level signal and hence the display LED's are turned off. In this scheme, minutes are displayed for $\frac{5}{8} \pm \frac{1}{8}$ second. Different intervals with different tolerances are possible by changing the clock frequency, the number of bits, and the state to be decoded as the "turn off" point. This circuit is not affected by switch bounce that occurs during the "make" or "break" of contact.

Although the device which has just been described appears to afford the greatest advantages for implementing the invention, it will be understood that various modifications can be made thereto without going beyond the scope of the invention, it being possible to replace certain elements with other elements capable of fulfilling the same technical functions therein.

What is claimed is:

1. A digital timing circuit in a digital watch with two electro-optical display elements, when said circuit is activated by a manually operable switch, the two display elements first display the hours information, for as long as the switch is closed and after the switch is opened, the display elements show the minutes information and then turn off, comprising:

a clock pulse source;

first gate means having first and second input connections and an output connection;

second gate means having first and second input connections and an output connection;

said second input of said second gate connected to said output of said first gate;

third gate means having first and second input connections and an output connection;

said output of said second gate connected to said second input of said third gate;

said first input of said second gate connected to said output of said third gate;

a manually operable switch for activiating said digital timing circuitry, said switch connected to said first input to said third gate;

first flip-flop having first and second input connections and first and second output connections;

second flip-flop having first and second input connections and first and second output connections;

said clock pulse source connected to said first input to said first flip-flop;

said first output of said first flip-flop connected to said second input to said first gate;

said first output of said second flip-flop connected to said first input of said first gate;

said first input to said third gate connected to the resets of said first and second flip-flop;

first and second electro-optical display elements which display the digits of first and second sets of horological information;

said first input to said third gate being connected to said first electro-optical display element;

said output of said second gate being connected to said second electro-optical display element;

said second set of horological information is displayed on said electro-optical display when said output of said second gate is at a logical binary high level and said input to said third gate is at a logical binary low level; and said first set of horological information is displayed on said electro-optical display when said output of said second gate and said input to said third gate are at a logical binary high level.

2. The digital timing circuit as recited in claim 1, wherein said first gate is an AND gate.

3. The digital timing circuit as recited in claim 1, wherein said second and third gates are NOR gates.

* * * * *